United States Patent [19]

Dirico

[11] 4,431,128

[45] Feb. 14, 1984

[54] ONE PIECE BLANK FOR NESTING DOUBLE TRAY, COVERABLE, BURGER AND FRIES BOX

[75] Inventor: Mark A. Dirico, Marshfield, Mass.

[73] Assignee: Hub Folding Box Co., Inc., Mansfield, Mass.

[21] Appl. No.: 347,521

[22] Filed: Feb. 10, 1982

[51] Int. Cl.[3] ..... B65D 5/22; B65D 5/48

[52] U.S. Cl. ..... 229/33; 229/15; 229/36

[58] Field of Search ..... 229/33, 36, 39 R, 18, 229/15

[56] References Cited

U.S. PATENT DOCUMENTS

| | | | |
|---|---|---|---|
| 576,664 | 2/1897 | Fanning | 229/33 |
| 780,662 | 1/1905 | Jessup | 229/18 |
| 1,578,119 | 3/1926 | Harris | 229/18 |
| 2,844,295 | 7/1958 | Williams | 229/33 |
| 2,942,770 | 6/1960 | Eichorn | 229/33 |
| 3,027,061 | 3/1962 | Locke | 229/33 |
| 3,658,235 | 4/1972 | Katzenmayer | 229/33 |

FOREIGN PATENT DOCUMENTS

| | | | |
|---|---|---|---|
| 79342 | 3/1931 | Sweden | 229/33 |
| 717950 | 11/1954 | United Kingdom | 229/33 |

*Primary Examiner*—Herbert F. Ross
*Attorney, Agent, or Firm*—Pearson & Pearson

[57] ABSTRACT

A one piece, flat, sheet of cardboard, or the like, is cut, slit, and scored to form a flat blank comprising an elongated, shallow, main tray section with a fore part for french fries and a rear part for a hamburg, as well as a laterally extending, shorter, shallow, tray section, foldable over the rear part to enclose the hamburg. The main tray includes a cover flap which folds over the french fries in the fore part of the main tray. Tongues and slots lock the dished hamburg cover and the flat french fry cover in closed position. The shallow, double trays, when partially erected, nest in stacks for storage and shipment because of tapered side walls.

6 Claims, 3 Drawing Figures

Fig. 2.
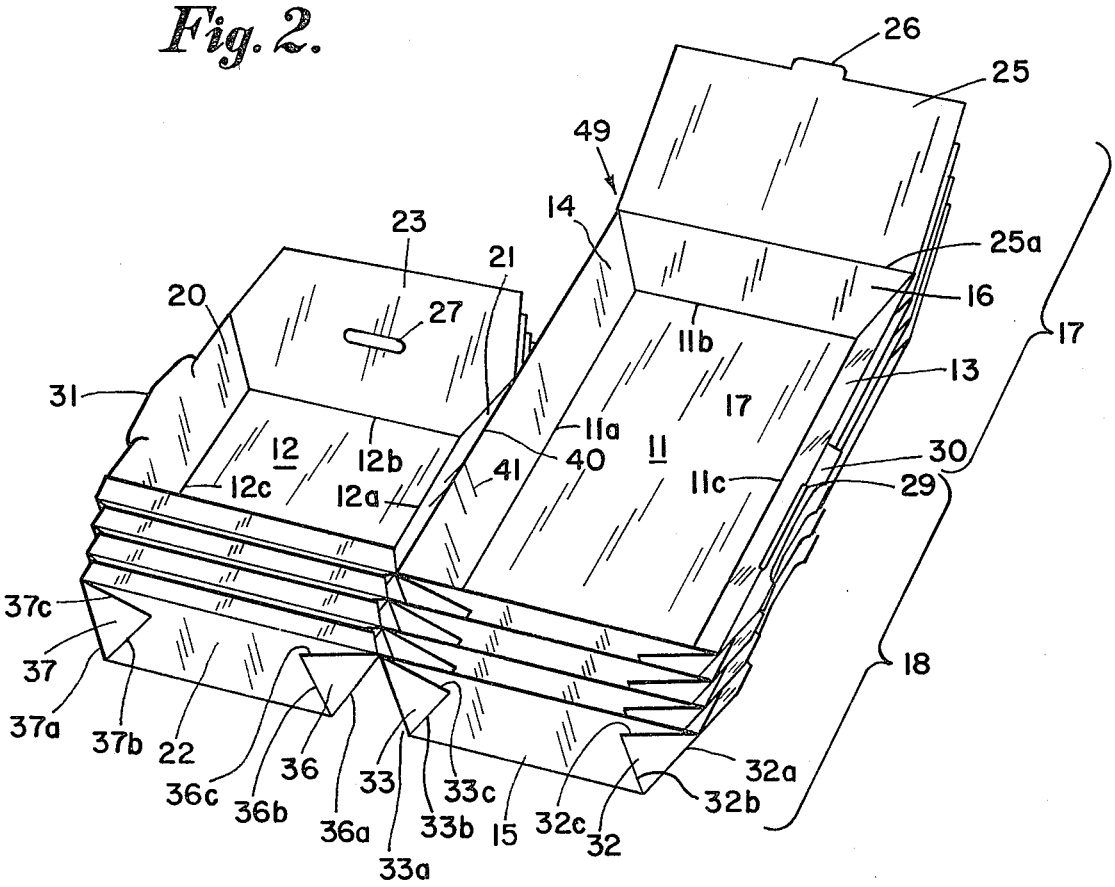
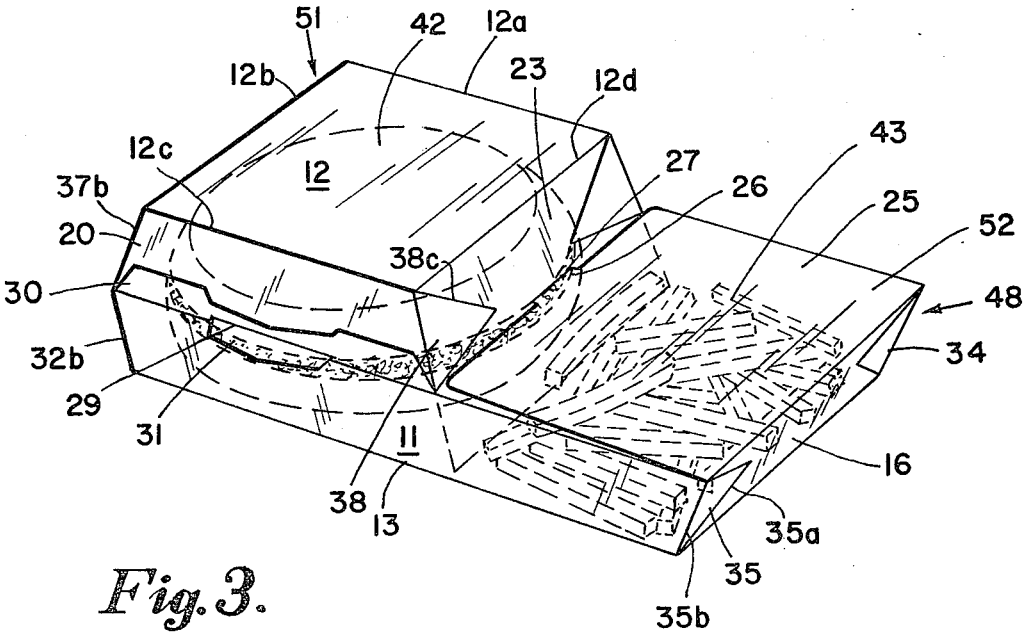
Fig. 3.

ONE PIECE BLANK FOR NESTING DOUBLE TRAY, COVERABLE, BURGER AND FRIES BOX

BACKGROUND OF THE INVENTION

The present invention relates to boxes made of a unitary blank of cardboard, by which is meant any type of paper or the like, from which boxes may be made. The invention also relates to a box partially made from such a blank, and also to the finally formed box.

It has heretofore been proposed to make a cardboard box with a low covered part, and a higher enclosed wing part, from a single blank of elongated generally rectangular outline, the wing part folded on laterally extending fold lines as in U.S. Pat. No. 2,844,295 to Williams of July 22, 1958.

SUMMARY OF THE INVENTION

According to the invention, from a sheet of cardboard (by which it is intended to include any like material from which folded boxes or the like may be formed) is cut, slit and scored, a one piece, with a longitudinal and lateral section, the former having fore and rear portions. The lateral section is joined at its longitudinal margin to the longitudinal rear of the longitudinal section. The sections having wings, or flaps, and are gored between flaps so that they may be folded into a prospective, or partially made erected nestable open box which has two, joined concave parts, a tray bottom formed from the longitudinal section and a tray-like future top cover for the rear longitudinal portion formed from the lateral section. The partially erected box may therefore be shipped in stacks of nested, open, upward facing double trays. Each box in use is first closed over a hamburg in the rear portion and then closed over french fries in the fore portion.

After a hamburger or the like is placed in the rear portion of the longitudinal section, the prospective hamburg cover may be folded over at the junction as a hinge to enclose the burger in a completed burger compartment. A tongue on the side wall flap of the hamburg cover tray locks in a slot in the corresponding side wall of the rear portion of the main tray. The forward wall of the burger compartment is formed from a forward wing or flap of the lateral section, that flap being longer in dimension than the other wings or flaps of that section to form a partition midway of the length of the elongated main tray. Then french fries or the like may be placed in the fore portion of the main tray bottom, and a flap, forwardly of the fore portion, is folded over to enclose and cover a fries compartment, and its tongue engaged in the flot in the forward wall, or partition, of the burger compartment formed from the elongated wing or flap.

DESCRIPTION OF THE DRAWINGS

The various objects, advantages, and novel features of the invention will be more fully apparent from the following detailed description, when read in connection with the accompanying drawing, in which like reference numerals refer to like parts and in which:

FIG. 2 is a perspective view of the partially folded, and erected box embodying the invention; and in the condition in which it will nest for shipment;

FIG. 3 is a perspective view of a completed box embodying the invention with the cover flaps closed and their tongues locked in their slots.

DESCRIPTION OF A PREFERRED EMBODIMENT

Figure 1:
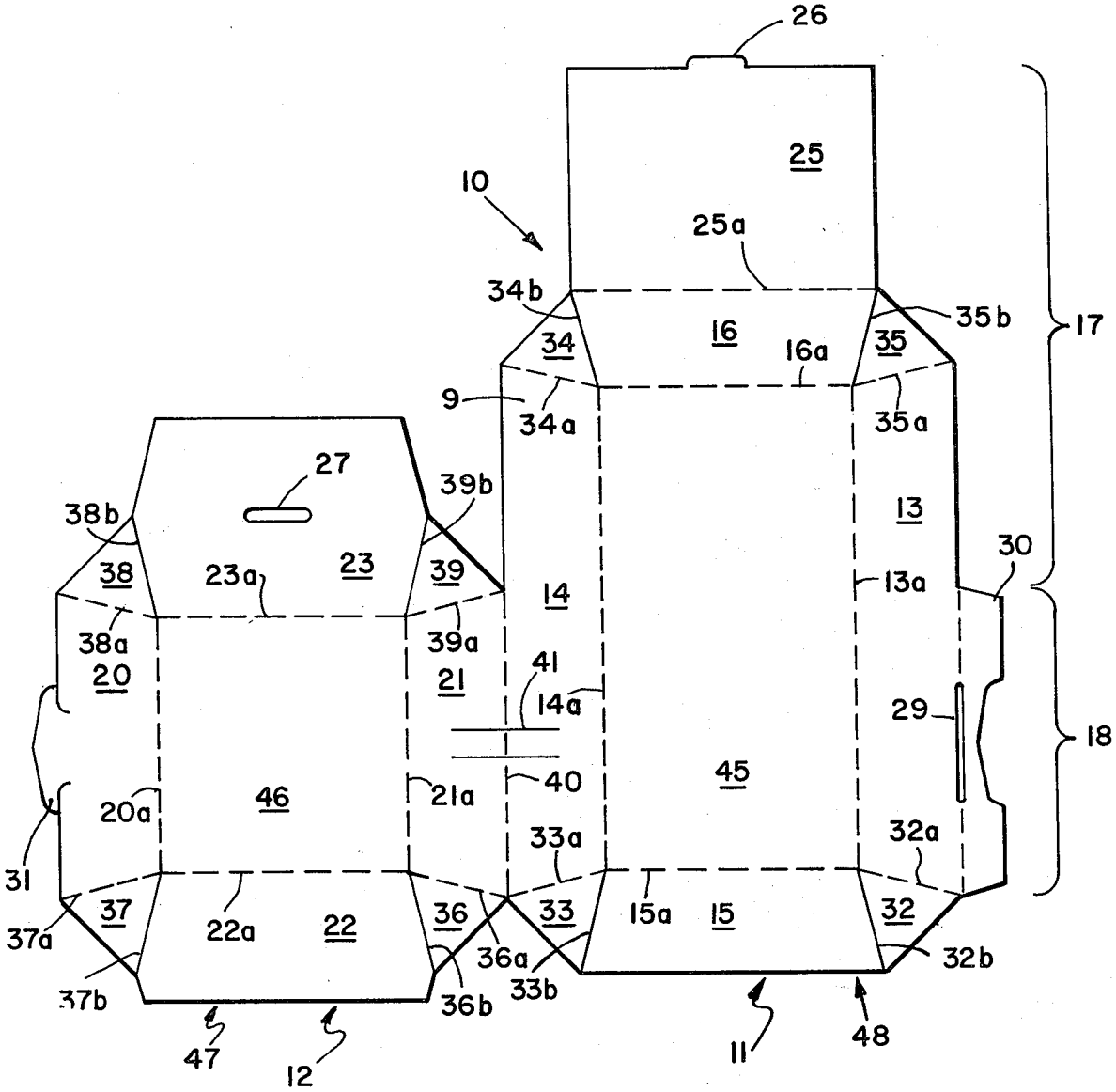
FIG. 1 is a plan view of a unitary, one piece, box blank embodying the invention.

The blank 10 of FIG. 1 comprises a single piece of cardboard 9. The blank 10 has a longitudinal section 11 and a lateral section 12. The terms forward, rear, up, down, lateral and the like are used for ease of description of the parts in a normal orientation. The parts may, of course, be oriented in other fashions. The longitudinal section 11 has flaps or wings 13, 14, 15, and 16 defined by fold lines 13*a*, 14*a*, 15*a*, and 16*a*. The longitudinal section shown in dotted lines has a fore portion 17 and a rear portion 18.

The lateral section 12 also has flaps or wings 20, 21, 22, and 23, defined by fold lines (dotted) 20*a*, 21*a*, 22*a*, and 23*a*, the latter being the forward flap and extending forwardly to have an outward extension greater than the other three flaps of the lateral section 12. A flap 25 extends forwardly from the forward wall flap 16 of the longitudinal section and is defined by a fold line 25*a*. Fold lines are distinguished in FIG. 1 by the use of dotted lines throughout. A locking tongue 26 is provided, centrally of the flap 25, which fits the tongue slot 27 in partition flap 23.

A tongue 30 extends laterally outward from the laterally outward extending flap 13 of the longitudinal section, and a tongue 31 extends laterally outward from the laterally outwardly extending flap 20 of the lateral section. One of them, in this instance the tongue 30, is incised, or cut through, at a slit 29.

Triangular tabs 32, 33, 34 and 35 are formed between adjacent pairs, respectively, of flaps 13, and 15, 15 and 14, 14 and 16, and 16 and 13. Each tab is slit at one side adjacent a flap, and designated by a suffix b with the tab reference numeral. Thus 32*b* is the slit side of tab 32. One side of each tab adjacent the other flap of its pair is scored to provide a fold line, indicated by a suffix a, such as 32*a*.

Triangular tabs 36, 37, 38, and 39 are formed between adjacent pairs, respectively of flaps 21, 22, 22 and 20, 20 and 23, and 23 and 21. Each of these tabs is also slit at one side adjacent a flap, designated by suffix b of the tab; one side of each tab adajacent the other flap of its pair is scored to provide a fold line, indicated by a suffix a.

Thus the longitudinal section 11 has an inner elongated, rectangular part forming the bottom panel 45 defined by the fold lines 13*a*, 14*a*, 15*a*, and 16*a* having two longer sides 13*a* and 14*a* in the longitudinal direction, and shorter sides 15*a* and 16*a* in the lateral direction. The lateral section 12 has an inner rectangular part forming the bottom panel 46 which is substantially square and of the same dimension as the shorter side of the rectangle of the longitudinal section 11. The flaps extend in obvious manner outwardly from their respective fold lines. The lateral section 12 width, i.e. its lateral extent is equal to the wdith of the longitudinal section 11 so that when the hamburg tray cover 47 is turned over onto the rear portion of the main tray 48, a closure is substantially effected.

The angles of all the tabs at their inner apexes each is less than a right angle, in order that, when the prospective boxes are formed, they may be readily formed to be concave or tapered for stacking.

One of the laterally extending flaps 21 and 14 of the lateral and longitudinal sections respectively (inner because they extend toward their junction) are joined at their outer margins at a scored fold line 40, (dotted) which is to serve as a hinge, the junction being at the rear portion 18 of the longitudinal section 11.

The other laterally extending flaps 13 and 20 have the tongues 30 and 31 already described. A pair of short cuts 41 are incised in flaps 21 and 14 normal to and centrally across hinge line 40.

Referring to FIG. 2, a partially folded box 49 is shown erected from the blank 10 is illustrated. The fold and slit lines are not distinguished in this figure, the only lines now appearing being those readily identified such as lines 41 across junction line 40, and the slit 29 to receive the tongue 31. The box has been erected by adhering the tabs to the forward and rear flaps 22 and 33 in the case of the lateral section, and the forward and rearward flaps 15 and 16 of the longitudinal section the flaps having been folded up as side walls to receive against their exterior the tabs now free to fold around them. The three sides of the lateral section 12 and the sides of the longitudinal section 11 formed by the various flaps provide about equal depth. The flaps of any one section may be different in their dimension outwardly (excepting the forward partition flap 23 of the lateral secton 12) from those of the other section, but it is convenient to form them alike in dimension. Because the tab inner apexes each are less than ninety degrees the sections 11 and 12 now erected respectively into a main tray and a tray-like cover for the finished box, are tapered to permit the stacking of one erected, double tray into another like double tray. The flaps 25 may remain upright or flat. This stacking or nesting conserves space in shipping or handling. The tabs are applied and affixed preferably to the exterior of the flaps by any suitable means, such as an adhesive, and when so exteriorly applied avoid any possible contamination of the comestibles in the finished box with any adhesive.

THE COMPLETED CLOSED BOX

The completed closed box of FIG. 3 illustrates the manner in which the lateral section 12 now may be brought over the rear of the longitudinal or bottom section 11 as a top for the burger compartment 51 by swinging the lateral section 12 around the hinge formed by the junction line 40, with the side walls formed by the now downwardly extending lateral section flaps 20, 21, and 22. The elongated partition flap 23 slips down into the bottom 11, and if a burger 42 has been placed in the rear portion 18 of the bottom 11, the flap 23 now serves to separate and close the burger compartment, with rectangular top 12 of the cover over the burger 42. The slits 41 afford some flexibility to the top to ease engagement of the tongue 31 in the slit 29. Fries 43 or the like may now be placed in the forward tray compartment 52 of the main tray 48, the French fry cover flap 25 brought forward and over the fries 43, and the tongue or lip 26 engaged in the slot 27 to close the forward or fries compartment 52, the flap 23 serving a double function as a common wall and the flap 25 serving as the fries compartment top.

The burger 42 is thus kept warm in its own compartment, if required, pending provision of the fries, and the fries 43 are kept warm in their own compartment when furnished. When access to the fries 43 is sought by removing the cover or flap 25, they are separately available and the burger 42 is readily reached by disengaging the tongue 31 from the slot 29. It is extremely convenient to have a single combined holder for the fries and burger, which obviates the necessity of putting a burger container and a fries container in yet another receptable for the consumer.

It will be apparent from the foregoing that there has been disclosed a box which is formed from a single piece of cut, slit, and scored cardboard. The unitary piece is readily folded and glued into an erected double tray box having a main tray and a tray like cover joined along a hinge line along the rear, both tray and cover being tapered to nest and to afford desirable stacking capability. The closed box provides separate compartments for a burger and fries, preventing their mixing after the box is closed, keeping the contents warm for future consumption, and avoiding the necessity for a further container to contain a separate burger box and a separate fries box.

I claim:

1. A one piece, flat box blank of cardboard, or the like, said blank comprising:

an elongated, main tray, section having a fore part and a rear part, said section having a flat, elongated, generally rectangular bottom panel with three hingedly connected sidewall flaps, and a fourth hingedly connected, combined sidewall flap and french fry cover flap extending forwardly therefrom; said section having triangular adhesive tabs for erecting the same into an elongated, shallow main tray with a fore part for containing french fries and a rear part for containing a hamburg;

a cover tray section, about half the length of said elongated main tray section, said cover section extending laterally from said main tray section and having a flat, generally square bottom panel, with three hingedly connected sidewall flaps and a fourth hingedly connected combined side wall flap and partition flap extending forwardly therefrom, said cover tray section having triangular adhesive tabs for erecting the same into a shallow tray-like cover;

said cover tray section having one of its said three side wall flaps hingedly connected to an adjacent one of the three side wall flaps of said main tray section, along the rear part thereof, and along a longitudinal fold line, to enable folding said cover tray section over the rear part of said main tray section to enclose a burger in said rear part;

all of said side wall flaps tapering outwardly to permit said main tray section and said cover tray section to nest in a compact stack, when folded, glued and erected into connected trays;

and tongue and slot means on said blank for locking said cover tray section over said rear part of said main tray section, and for locking said french fry cover flap over said fore part of said main tray section.

2. A one piece, flat box blank as specified in claim 1 wherein:

said tongue and slot means includes an integral tongue extending forwardly from the french fry cover flap of said main tray section and a tongue slot for, receiving said tongue, in the combined side wall flap and partition flap of said cover tray section.

3. A one piece flat box blank as specified in claim 1 wherein:

said tongue and slot means includes an integral tongue extending laterally outwardly from the center of the side wall flap of said cover tray section, opposite the said one flap thereof hingedly connected to a side flap of the main tray section and a tongue slot for receiving said tongue in the center of the rear part of the side wall of the main tray section opposite to the one of the three side walls thereof hingedly connected to an adjacent side wall of said cover section.

4. A partially formed box made from a one piece blank of cardboard or the like, said box comprising:

an upward facing, elongated main tray, of predetermined length and width, having a rectangular, flat bottom and four upstanding, outward tapered, side walls, hingedly connected thereto, said tray having a fore part and a rear part;

an upward facing, tray-like cover of predetermined length about half the length of said main tray and equal in width to said main tray, said cover having a generally square bottom and four upstanding, outward tapered, side walls hingedly connected thereto, one of the side walls of said cover being hingedly connected to the adjacent side wall of said main tray, along the rear part thereof and along a longitudinal fold line, so as to cover the same when overfolded laterally on said hinge connection;

said main tray having one of its four side walls, formed with an integral forward extension to serve as a cover flap over the fore part of said main tray; and said tray-like cover having one of its four side walls formed with an integral forward extension to serve as a partition extending down into said main tray to separate the rear part thereof from the fore part thereof.

5. A partially formed box as specified in claim 4 wherein:

said integral forward extension serving as a cover flap includes a forwardly extending, integral tongue and said partition includes a central tongue slot for receiving said tongue.

6. A burger-fries box made from a one piece blank of cardboard or the like, said box comprising:

an elongated main tray with fore and rear parts and four upstanding, outward tapering side walls and a cover tray extending laterally from the rear part of said main tray and hingedly connected thereto, along a longitudinal fold line to fold laterally along a longitudinal fold line, over the rear part of said main tray, said cover tray also having four, outward tapering, side walls depending downwardly therefrom when in cover position over said main tray;

said main tray having an integral extension on the forward side wall, of the fore part thereof, forming a hinged cover for said fore part;

and said cover tray having an integral extension on the forward side wall thereof forming a partition between the fore part and the rear part of said main tray.

* * * * *